US007398904B2

(12) United States Patent
Zurkirchen et al.

(10) Patent No.: US 7,398,904 B2
(45) Date of Patent: Jul. 15, 2008

(54) FASTENING ELEMENT GUIDE DEVICE FOR A POWER DRIVE-IN TOOL

(75) Inventors: Marco Zurkirchen, Bubikon (CH); Marcel Koelliker, Küsnacht (CH); Sven Matthiesen, Lindau (DE)

(73) Assignee: Hilti Aktiengesellschaft, Schaan (LI)

( * ) Notice: Subject to any disclaimer, the term of this patent is extended or adjusted under 35 U.S.C. 154(b) by 71 days.

(21) Appl. No.: 11/436,792

(22) Filed: May 17, 2006

(65) Prior Publication Data

US 2006/0265886 A1 Nov. 30, 2006

(30) Foreign Application Priority Data

May 30, 2005 (DE) ..... 10 2005 000 068

(51) Int. Cl.
*B25B 23/04* (2006.01)

(52) U.S. Cl. ..... 227/119; 227/109; 227/136; 227/156; 81/434

(58) Field of Classification Search ..... 227/109, 227/119, 136, 107, 139, 142, 10, 156; 81/433, 81/434, 57.37, 439, 57.16; 173/29, 170
See application file for complete search history.

(56) References Cited

U.S. PATENT DOCUMENTS 5,083,483 A * 1/1992 Takagi ..... 81/434
5,584,221 A * 12/1996 Petrantoni ..... 81/434
5,671,645 A * 9/1997 Murayama et al. ..... 81/434
5,687,624 A * 11/1997 Tsuge et al. ..... 81/439
5,974,918 A * 11/1999 Nakagawa et al. ..... 81/434
6,170,366 B1 * 1/2001 Jalbert et al. ..... 81/434
6,363,818 B1 * 4/2002 Habermehl ..... 81/434
6,655,573 B1 * 12/2003 Chang et al. ..... 227/109
6,783,044 B2 * 8/2004 Perra et al. ..... 227/8
6,915,724 B2 * 7/2005 Kigel et al. ..... 81/434
7,017,790 B1 * 3/2006 Peng ..... 227/119
7,082,857 B1 * 8/2006 Hoffman ..... 81/57.16
7,134,367 B2 * 11/2006 Gehring et al. ..... 81/434

* cited by examiner

*Primary Examiner*—Scott A. Smith
(74) *Attorney, Agent, or Firm*—Abelman, Frayne & Schwab

(57) ABSTRACT

A fastening element guide device for a power drive-in tool includes a coupling section (14) having a chamber (17) for receiving a matching coupling section (41) of power drive-in tool (40) at least one locking member (21, 22) displaceable between a locking position (28) in which its locking section (23) projects into the receiving chamber (17) for engaging a recess (43) provided on the matching coupling section (41) of the power drive-in tool (40) for lockingly secure the guide device (10) on the power drive-in tool (40), and a release position (29) in which the locking section (43) is withdrawn from the receiving chamber (17) a spring (25) for biasing the at least one locking member (21, 22) to its locking position (28), and an actuation section (24) accessible from outside for manually displacing the at least one locking member (21, 22) from the locking position (28) to the release position (29).

3 Claims, 4 Drawing Sheets

FASTENING ELEMENT GUIDE DEVICE FOR A POWER DRIVE-IN TOOL

BACKGROUND OF THE INVENTION

1. Field of the Invention

The present invention relates to a fastening element guide device for a power drive-in tool and which includes a coupling section having a chamber for receiving a matching coupling section of the power drive-in tool, and at least one locking member arranged on the coupling section, having a locking section and displaceable between a locking position in which the locking section projects into the receiving chamber for engaging a recess provided on the matching coupling section of the power drive-in tool for lockingly secure the guide device on the power drive-in tool, and a release position in which the locking section is withdrawn from the receiving chamber.

2. Description of the Prior Art

Fastening element guide devices of the type described above are used with power drive-in tools such as e.g., screwdriving tools, and are formed, e.g., as pure fastening element magazines or also as extension devices.

U.S. Patent Publication US 2004/0099105 A1 discloses a screw guide device for a drive-in or screwdriving tool the main body of which can be secured on a flange of a screwdriving tool with a clamping ring. A barrel of the fastening element guide device is displaceably arranged with a tubular member on a first constructural component. A lever with an eccentric is arranged on the clamping ring. With the lever, a screw that extends through the two ends of the clamping ring, can be tightened to reduce the clamping ring diameter.

The drawback of the disclosed guide device consists in that for releasing the lever, dependent on screw prestress, a rather big force has to be applied. In addition, the clamping ring is susceptible to wear and damage.

German Publication DE 103 57 485 A1 discloses a screwdriving tool with a fastening element guide device mounted thereon. The screwdriving tool has a holding projection on the outer circumference of which a groove is formed.

On the holding projection of the screwdriving tool, the attachment sleeve of the fastening element guide device, which is fixedly secured in the guide device housing, can be secured. The attachment sleeve has two opposite openings in which clamping members are radially displaceable. A rotatably supported locking collar surrounds the attachment sleeve. The locking collar is provided on its inner surface with circumferential grooves for clamping elements. By pivoting the locking collar, the clamping element can be reversibly displaced in a locking position in which the clamping surfaces of the clamping elements engage in the recess or recesses on the holding projection and in the circumferential grooves of the locking collar. A detent collar with spring fingers provides for retaining of the locking collar on the attachment sleeve.

The drawback of the device according to DE 103 57 485 A1 consists in large number of parts necessary for mounting of the fastening element guide device on the screwdriving tool.

An object of the present invention is a fastening element guide device in which the drawbacks of the prior art devices are eliminated and which can be easily handled.

SUMMARY OF THE INVENTION

This and other objects of the present invention, which will become apparent hereinafter are achieved by providing a fastening element guide device including a spring for biasing the at least one locking member to its locking position, and an actuation section accessible from outside for manually displacing the at least one locking member from the locking position to its release position.

The novel features of the present invention provide for automatic displacement of the locking member to its locking position under the biasing force of the spring, and only the displacement to the release position is effected manually. The arrangement of the actuation section directly on the locking member permitted to reduce the number of components of the locking arrangement and, thereby, to reduce the manufacturing and assembly costs.

According to an advantageous embodiment of the present invention, there are provided two locking members displaceable in opposite directions away from each other and toward each other. The displacement of the locking members in the opposite directions prevents an inadvertent release of the locking means as both locking members need be operated in order to release the guide device from the drive-in tool.

It is advantageous when each locking member is formed as a U-shaped member a first U-leg of which is formed as a guide bush and a second U-leg of which is formed as a guide pin, and the guide pin of one of the locking members is displaceably guided in the guide bush of another of the locking members, respectively.

With such a shape and arrangement of the locking members, they can be displaced in opposite directions, while simultaneously surrounding the receiving chamber of the coupling section, whereby easily mountable locking elements are provided.

Advantageously, there are provided two springs, which are arranged, respectively, in the guide bushes of the locking members, and bias the guide bushes against the guide pins. Thereby, no additional space is needed for the springs.

Advantageously, the locking sections of the locking members are arranged at guide pin-receiving ends of the guide bushes, respectively, and the locking sections project from the respective guide bushes in form of arches, partially surrounding the receiving chamber of the coupling section of the guide device in which the matching coupling section of the drive-in tool is received. This permits to achieve good kinematics, as the locking sections are subjected to a tensioning load of the springs.

The novel of the features of the present invention, which are considered as characteristic for the invention, are set forth in the appended claims. The invention itself, however, both as to its construction and its mode of operation, together with additional advantages and objects thereof, will be best understood form the following detailed description of a preferred embodiment, when read with reference to the accompanying drawings.

DETAILED DESCRIPTION OF THE PREFERRED EMBODIMENTS

Figure 1:
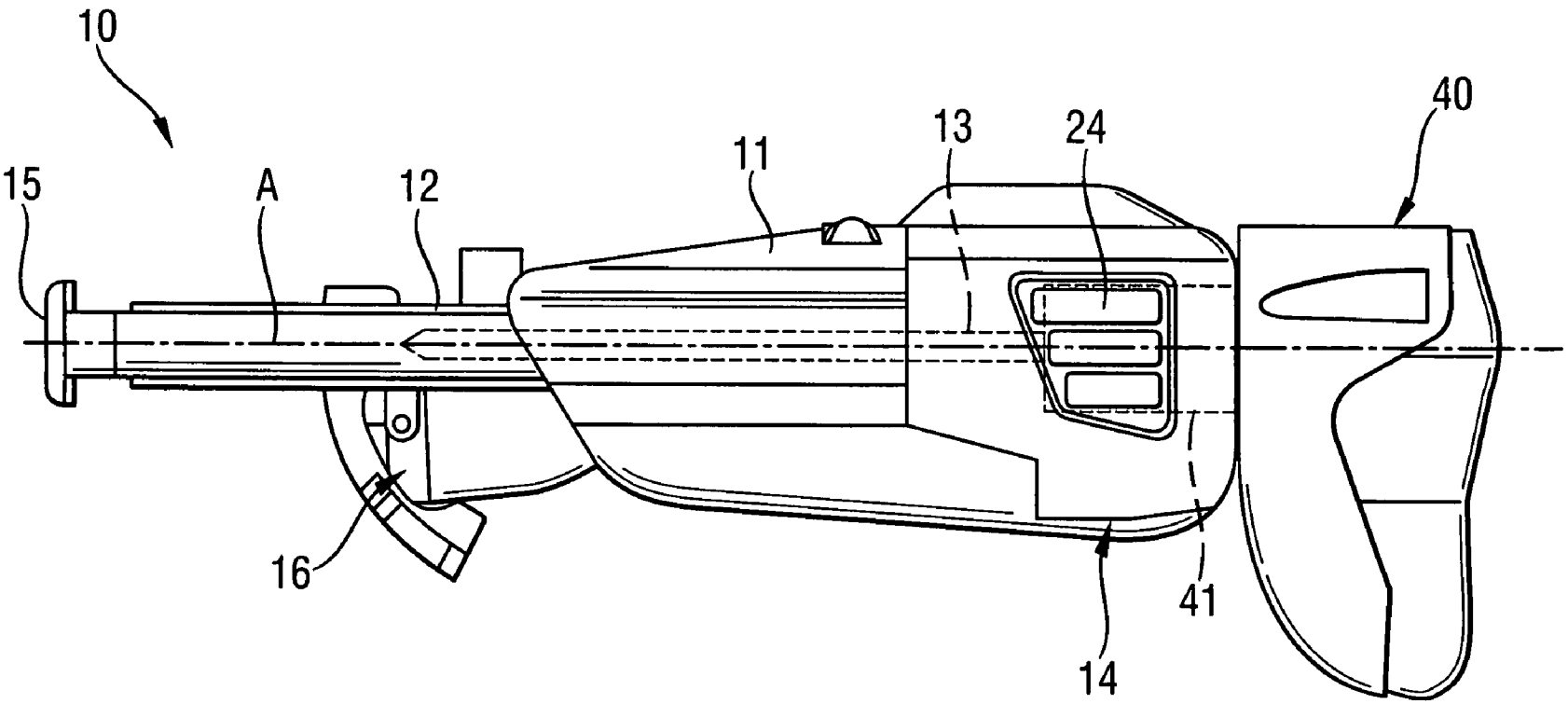
FIG. 1 a side view of a drive-in tool with a fastening element guide device according to the present invention mounted thereon.

A fastening element guide device, which is generally designated with a reference numeral 10 and is shown in FIGS. 1-4, includes a coupling section 14 with which the guide device 10 is releasably mounted on a matching coupling section 41, which is formed as a holding projection, of a power drive-in tool 40 only a working tool end of which is shown in the drawings. The power drive-in tool 40, which is only partially shown in the drawings, is formed as an electrical screwdriving tool. The coupling section 14 has a receiving chamber 17 into which the matching coupling section 41 of the drive-in tool 40 is insertable.

The fastening element guide device 10 is formed as a screw magazine with an integrated transport mechanism 16 for transporting a magazine strip with screws. In the fastening element guide device 10, a drive-in bit 13, which is formed as a screwdriving bit and can be rotated by the power tool 40, is displaced. The drive-in bit 13 is connectable with a chuck 42 of the drive-in tool 40. The drive-in bit 13 defines a tool axis "A."

The fastening element guide device 10 has a guide unit 11 that contains the coupling section 14 and is formed as a guide housing, and a slide 12 supported on the guide unit 11 for displacement in the direction of the tool axis A. The guide unit 11 carries the transport mechanism 16 and guides the screw magazine strip. The guide unit 11 also has a stop 15 with which the fastening element guide device 10 engages a constructional component for effecting a drive-in process.

Figure 2:
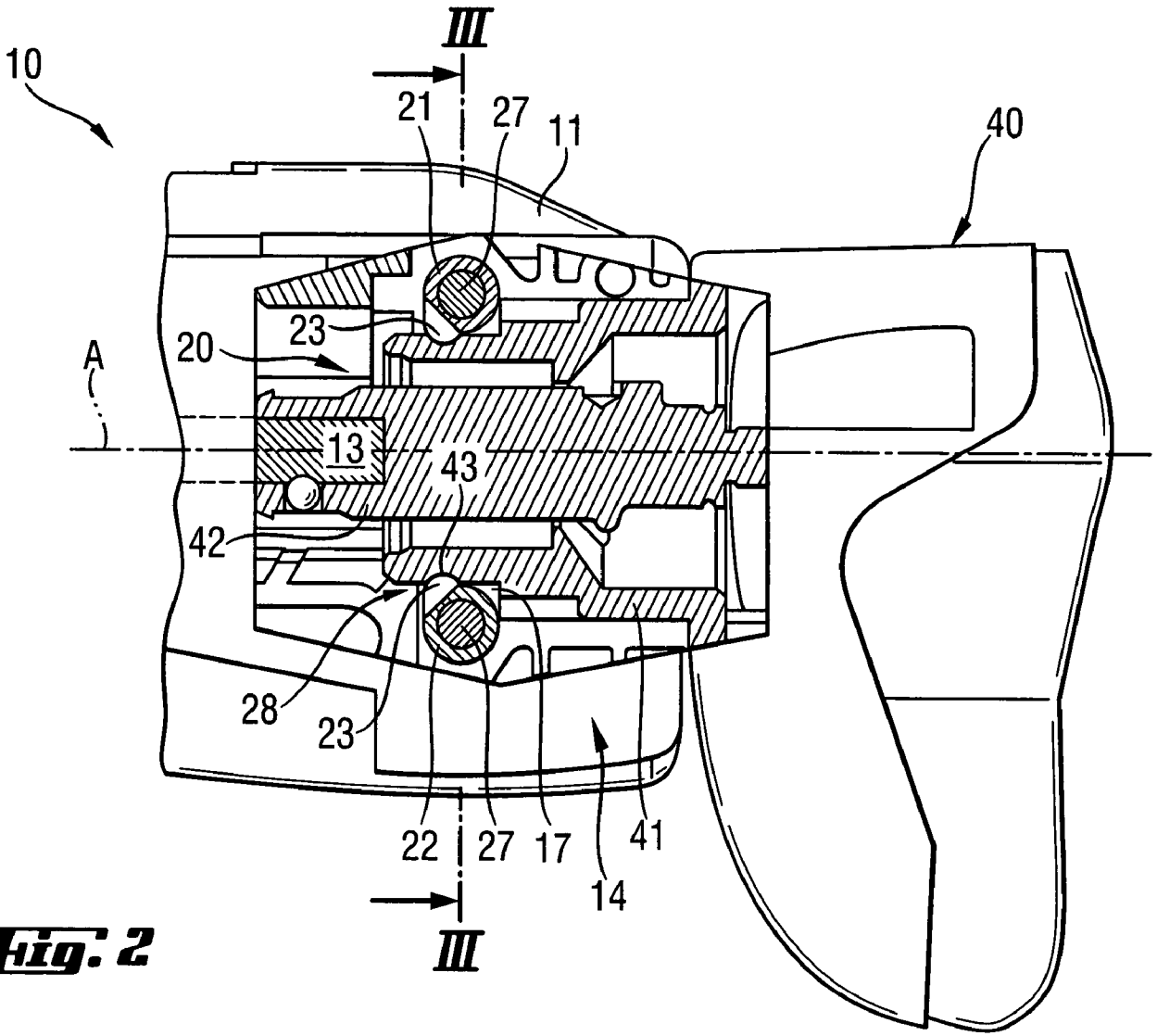
FIG. 2 a partially cross-sectional side view of the fastening element guide device shown in FIG. 1.
Figure 3:
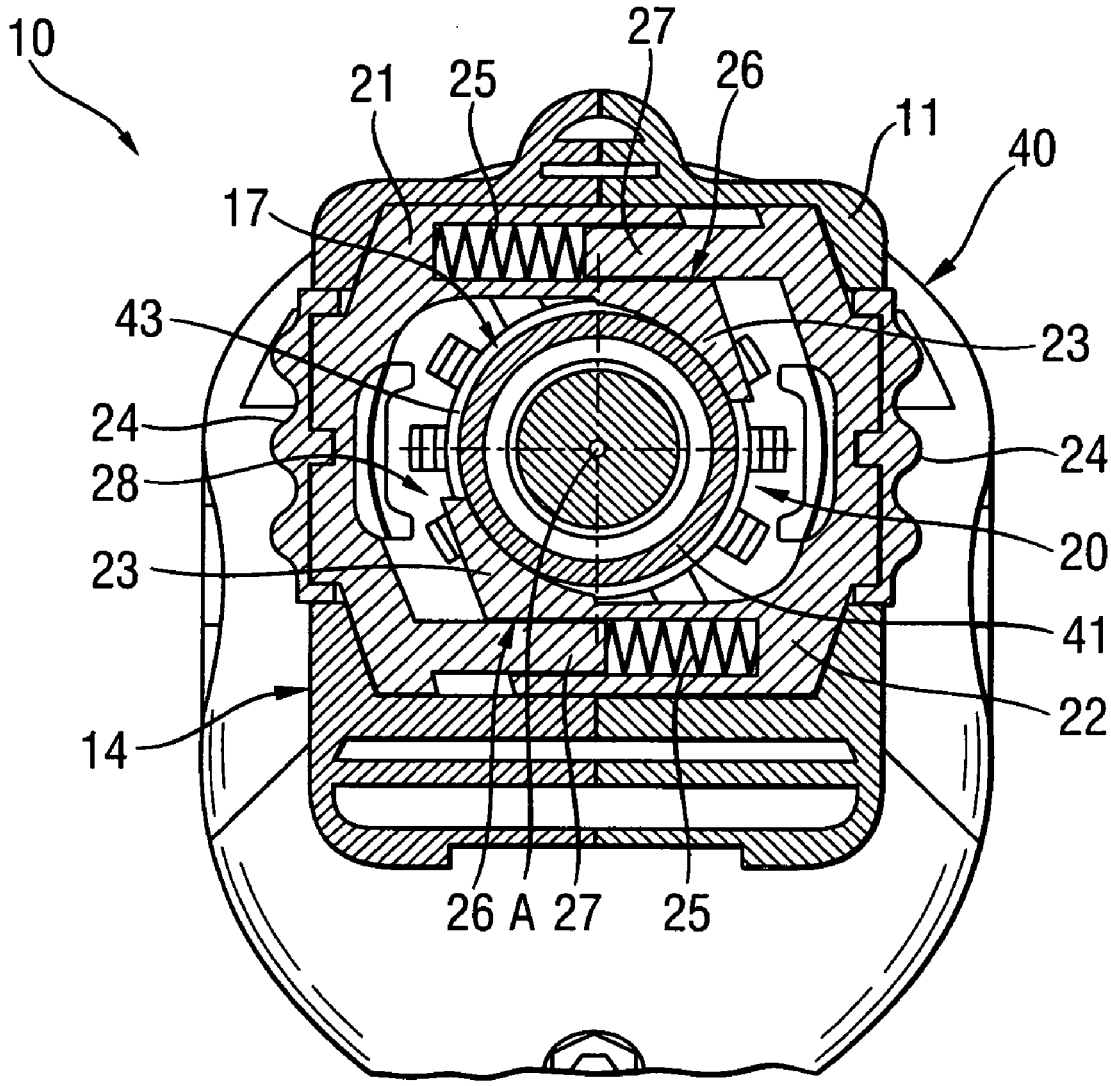
FIG. 3 a cross-sectional view along line III-III of the fastening element guide device shown in FIG. 2 in a locking position of the locking device.

On the coupling section 14, which is formed as a coupling sleeve in which the matching coupling section 41 of the drive-in tool 40 is received, a locking device, which is generally designated with reference numeral 20, is arranged. The locking device 20 has a first locking member 21 and a second locking member 22 which together surround the tool axis A. Each of the locking members 21, 22 is approximately U-shaped, and a U-leg of the locking members 21, 22 has a cylindrical guide bush 26 and a locking section 23 projecting at an end of the guide bush 26. The locking section 23 is further bent away from the guide bush 26 by a small amount in the circumferential direction about the tool axis A. In the guide bush 26, there is arranged a spring 25, and a pin 27 of the respective other guide member 21, 22 is axially displaceable in the guide bush 26. The spring 25 biases the guide pin 27 in a direction out of the guide bush 26. Thereby, both locking members 21, 22 are pressed away from each other. Thereby, the displacement of the guide unit 11, which acts, regionwise, as a stop for the locking members 21, 22, is limited. When the fastening element guide device 10 is pinned with its coupling section 14 on the matching coupling section 41 of the power drive-in tool 10, as shown in FIGS. 1-3, the locking members 21, 22 surround the matching coupling section 41 an the locking sections 23 project into the receiving chamber 17 and engage in a circumferential recess 43 or a groove provided on the outer circumference of the matching coupling section 41 that extends into the receiving chamber 17. In this locking position, which is designated with a reference numeral 28, the diametrically opposite locking sections 23 of the locking members 21, 22 are automatically held by the springs 25 which bias the locking members 21, 22 in opposite directions. Thereby, the locking sections 23 are pulled in the direction of the recess 43 or the tool axis A.

On the locking members 21, 22, there are provided, respectively, on the bases between the U-leg forming the guide bush 26 and the U-leg forming the guide pin 27, actuation sections 24 which extend through the wall of the guide unit 11 or the guide house and can be manually actuated from outside. The actuation sections 24 and the respective locking members 21, 22 are fixedly connected with each other or are formed as one-piece parts.

Figure 4:
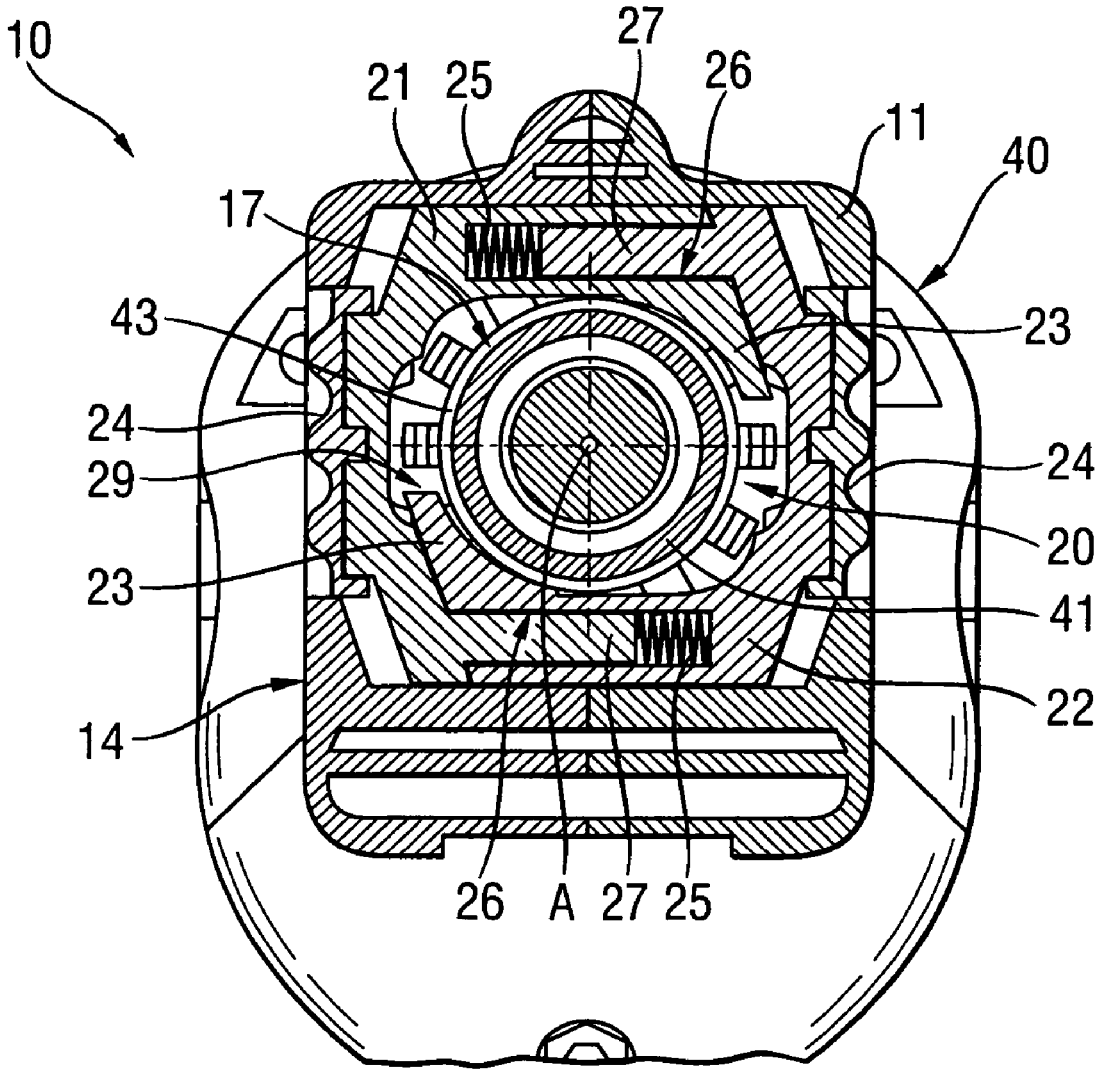
FIG. 4 a cross-sectional view of the fastening element guide device similar to that of FIG. 3, with the locking device in its release position.

In order to displace the locking members 21, 22 from the locking position 28 shown in FIG. 3, to a release position 29, shown in FIG. 4, the actuation sections 24 are pressed manually in the direction toward the tool axis A in the guide unit 11 or in the guide housing. With the locking members 21, 22 being displaced toward each other, the guide pins 27 would be displaced in the guide bushes 26 against the biasing force of the respective springs 25 and the locking sections 23 would move out of the respective recesses 43 on the surface of the matching coupling section 41 of the drive-in tool 40 until the matching coupling section 43 can be withdrawn from the coupling section 14 of the fastening element guide device 10. The locking sections 23 would be outside of the receiving chamber 17.

Upon release of the actuation sections 24, the locking members 21, 22 are displaced by the biasing force of springs 25 away from each other, with the locking sections 23 moving toward each other in the direction of the tool axis A.

In order to prevent rotation of the fastening element guide device 10 when it is mounted on the drive-in tool 40, appropriate projections and corresponding recesses, which extend in the direction of the tool axis A can be formed on the coupling sections of the guide device and the matching coupling section of the drive-in tool, respectively, so that in the coupled condition, the projections would engage in respective recesses, insuring interlocking of the fastening element guide with the drive-in tool.

Further, instead of the circumferential recess or groove in which the locking projections engage, there can be provided a number of recesses the number and circumferential length of which correspond to the number of the locking sections 23, so that interlocking would be insured in the coupled condition.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A fastening element guide device for a power drive-in tool, comprising a coupling section (14) having a chamber (17) for receiving a matching coupling section (41) of power drive-in tool (40); at least one locking member (21, 22) arranged on the coupling section (14), having a locking section (23) and displaceable between a locking position (28) in which the locking section (23) projects into the receiving chamber (17) for engaging a recess (43) provided on the matching coupling section (41) of the power drive-in tool (40) for lockingly securing the guide device (10) on the power drive-in tool (40), and a release position (29) in which the locking section (43) is withdrawn from the receiving chamber (17); spring means (25) for biasing the at least one locking member (21, 22) to the locking position (28) thereof; an actuation section (24) accessible from outside for manually displacing the at least one locking member (21, 22) from the locking position (28) thereof to the release position (29) thereof; and a further locking member (21, 22), the at least one locking member (21, 22) and the further locking member (21, 22) being displaceable in opposite directions, away from each other and toward each other, wherein each locking member (21, 22) is formed as a U-shaped member a first U-leg of which is formed as a guide bush (26) and a second U-leg of which is formed as a guide pin (27), and wherein the guide pin (27) of one of the locking members (21, 22) is displaceably guided in the guide bush (26) of another of the locking members (21, 22), respectively.

2. A fastening element guide device according to claim 1, wherein the spring means (25) comprises two springs arranged, respectively, in the guide bushes (26) of the locking members (21, 22), and wherein the guide bushes (26) are supported against respective guide pins (27).

3. A fastening element guide device according to claim 1, wherein the locking sections (23) of the locking members (21, 22) are arranged at guide pin- (27) receiving ends of the guide bushes (26), respectively, and wherein the locking sections (23) project from the respective guide bushes (26) in form of arches, partially surrounding the receiving chamber (17) of the coupling section (14) of the guide device (10) in which the matching coupling section (41) of the drive-in tool (40) is received.

* * * * *